US005491309A

United States Patent [19]

Kotter

[11] Patent Number: 5,491,309

[45] Date of Patent: Feb. 13, 1996

[54] ACOUSTICAL PANEL SYSTEM

[75] Inventor: Rodman W. Kotter, Culver City, Calif.

[73] Assignee: Quilite International Limited Liability Company, Los Angeles, Calif.

[21] Appl. No.: 131,445

[22] Filed: Oct. 4, 1993

Related U.S. Application Data

[63] Continuation-in-part of Ser. No. 817,155, Jan. 6, 1992, abandoned, which is a continuation-in-part of Ser. No. 586,793, Sep. 24, 1990, Pat. No. 5,077,949, which is a continuation-in-part of Ser. No. 355,788, May 19, 1989, Pat. No. 4,958,476, which is a division of Ser. No. 174,516, Mar. 28, 1988, abandoned.

[51] Int. Cl.[6] ..... E04B 1/00

[52] U.S. Cl. ..... 181/285; 181/210; 52/144

[58] Field of Search ..... 181/210, 285, 181/286, 287, 288, 293, 295, 290; 52/144, 145, 506, 630, 724, 732, 745

[56] References Cited

U.S. PATENT DOCUMENTS

| | | | |
|---|---|---|---|
| 304,792 | 9/1884 | Butz . | |
| 881,522 | 3/1908 | Winslow . | |
| 943,306 | 12/1909 | Harry . | |
| 1,049,543 | 1/1913 | Smith . | |
| 1,158,307 | 10/1915 | Schmidt . | |
| 1,231,348 | 6/1917 | Hernandez . | |
| 1,247,511 | 11/1917 | Dickelman . | |
| 1,585,266 | 5/1926 | Schlafly . | |
| 1,605,513 | 11/1926 | Connery . | |
| 1,989,834 | 2/1935 | Watson . | |
| 2,102,936 | 12/1937 | Bailey . | |
| 2,164,966 | 7/1939 | Tutein . | |
| 2,733,784 | 2/1956 | Berry . | |
| 2,792,164 | 5/1957 | Cauffiel . | |
| 3,099,900 | 8/1963 | Beck . | |
| 3,186,524 | 6/1965 | Spaeth, Jr. . | |
| 3,254,459 | 6/1966 | Bodley . | |
| 3,346,998 | 10/1967 | Nelson . | |
| 3,444,558 | 5/1969 | Leitner . | |
| 3,477,894 | 11/1969 | Graff et al. . | |
| 3,524,288 | 8/1970 | Coppa . | |
| 3,538,664 | 11/1970 | Frandsen et al. . | |
| 3,557,501 | 1/1971 | Kolozsvary . | |
| 3,638,434 | 2/1972 | Deleare . | |
| 3,810,336 | 5/1974 | Sadao . | |
| 3,893,277 | 7/1975 | Constant . | |
| 3,967,023 | 6/1976 | Lysek . | |
| 4,114,725 | 9/1978 | Croasdale | 181/210 X |
| 4,115,963 | 9/1978 | Lubov . | |
| 4,143,495 | 3/1979 | Hintz | 52/145 |
| 4,308,698 | 1/1982 | Fleishman . | |
| 4,375,491 | 3/1983 | Honig . | |
| 4,401,705 | 8/1983 | Ewert . | |
| 4,414,257 | 11/1983 | Haraga et al. . | |
| 4,665,665 | 5/1987 | Wilkinson . | |
| 4,776,139 | 10/1988 | Lockwood . | |
| 4,836,787 | 6/1989 | Boo . | |
| 4,953,329 | 9/1990 | Frantl . | |
| 4,958,476 | 9/1990 | Kotter . | |
| 5,077,949 | 1/1992 | Kotter . | |

FOREIGN PATENT DOCUMENTS

| | | |
|---|---|---|
| 522270 | 3/1956 | Canada . |
| 606670 | 6/1926 | France . |
| 1280028 | 5/1962 | France . |
| 1340142 | 9/1963 | France . |
| 360935 | 7/1938 | Italy . |
| 509434 | 7/1939 | United Kingdom . |

*Primary Examiner*—Khanh Dang
*Attorney, Agent, or Firm*—Pretty, Schroeder, Brueggemann & Clark

[57] ABSTRACT

An acoustical panel system, including panels formed out of relatively thin sheet material, that can be utilized to construct walls, fences, and other structures. A frame structure has one or more openings to receive the acoustical panels. Each acoustical panel has at least one raised body portion, all or part of which is corrugated to disburse sound and provide structural integrity, and an edge portion surrounding the body portion. A pair of acoustical panels can be adjoined back-to-back to form a hollow block to provide both enhanced sound and heat insulating properties. A hollow bezel extends around the periphery of the body portion of the panel and is spaced from the body portion of the panel and has one or more openings into which sounds are received and trapped within the bezel.

28 Claims, 9 Drawing Sheets

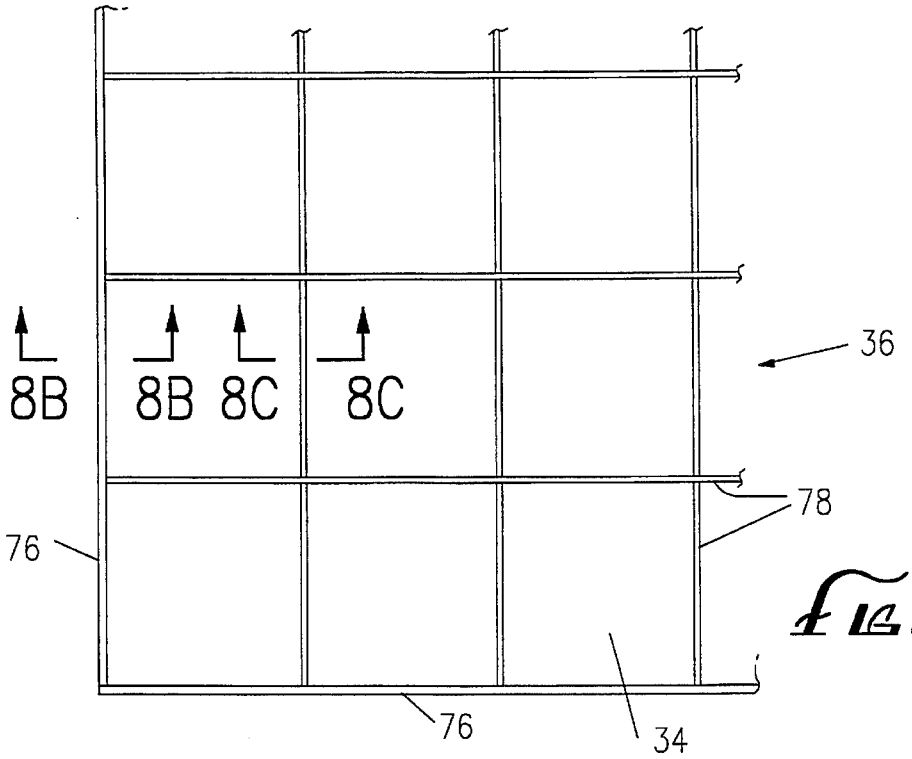
FIG. 7
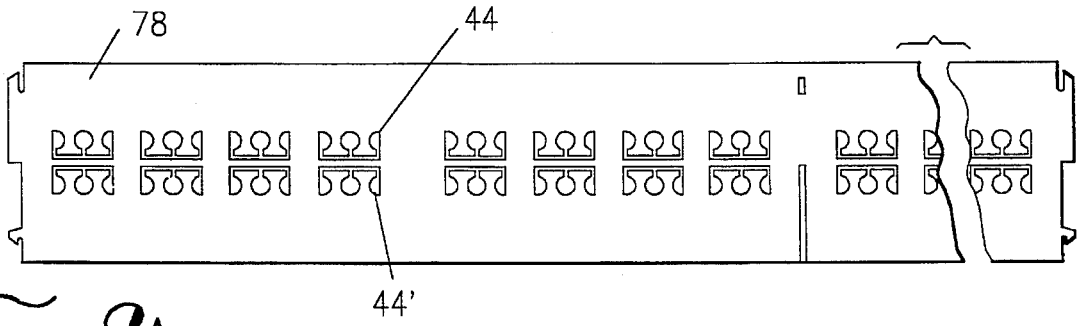
FIG. 8A
FIG. 8B
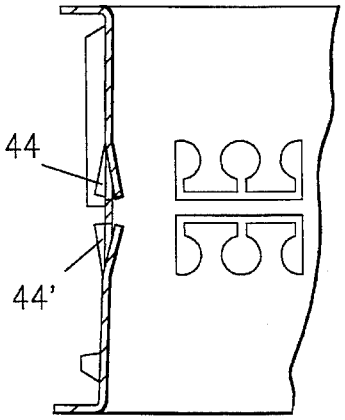
FIG. 8C
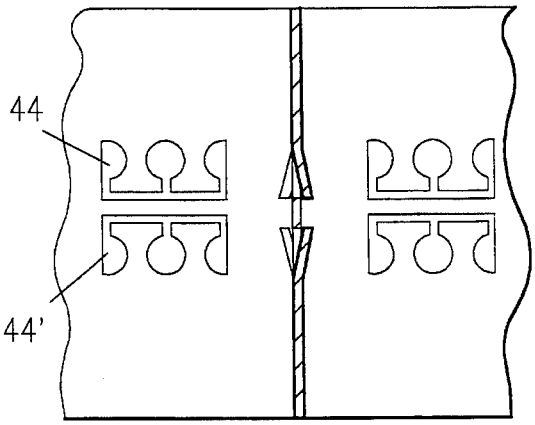

FIG. 9A
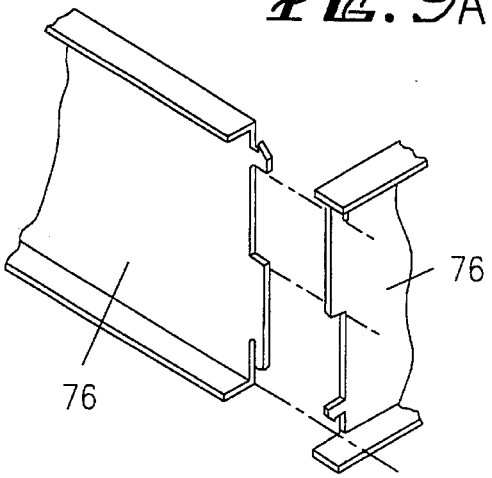
FIG. 9B
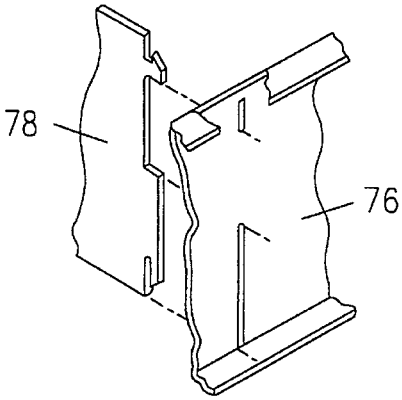
FIG. 9C
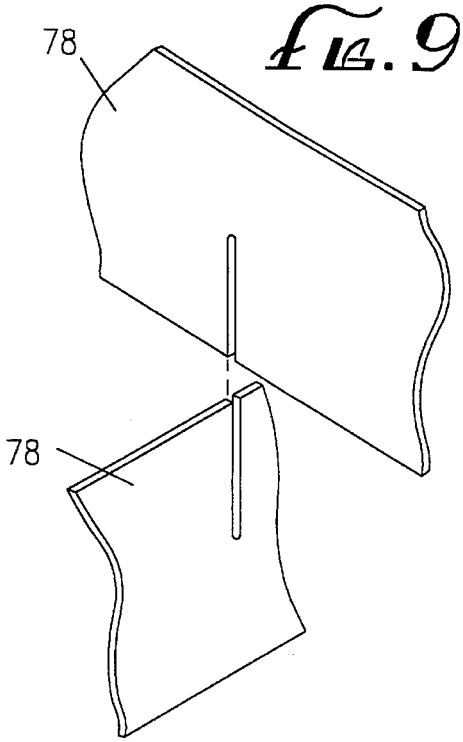
FIG. 13A
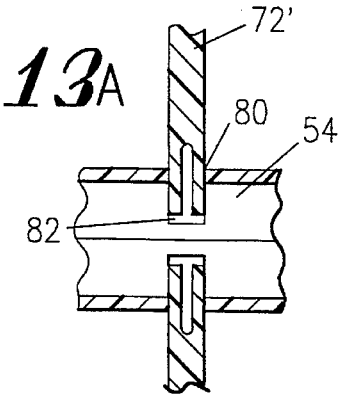
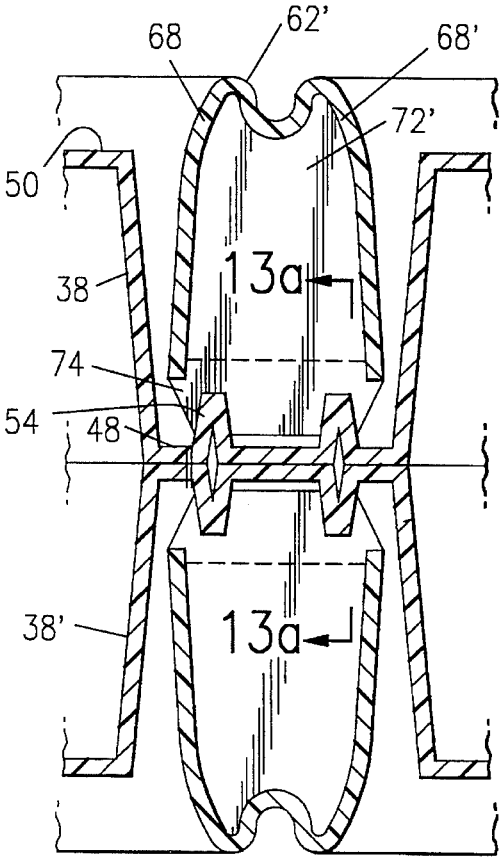
FIG. 13

ACOUSTICAL PANEL SYSTEM

BACKGROUND OF THE INVENTION

This is a continuation-in-part of application Ser. No. 817,155, filed Jan. 6, 1992 abandoned, which is a continuation-in-part of application Ser. No. 586,793, filed Sep. 24, 1990, now U.S. Pat. No. 5,077,949, which is a continuation-in-part of application Ser. No. 355,788, filed May 19, 1989, now U.S. Pat. No. 4,958,476, which is a divisional of application Ser. No. 174,516, filed Mar. 28, 1988, now abandoned.

The present invention concerns acoustical structures, and more particularly, relates to an acoustical panel system for constructing walls, fences and the like with enhanced noise reduction properties.

Acoustical structures can be employed to reduce either the transmission of sound or the reflection of sound, or both. The ability of an acoustical structure to reduce the transmission of sound can be measured by what is known as the insertion or transmissive loss of the structure. Similarly, the ability of an acoustical structure to reduce the reflection of sound can be measured by the absorption or reflective loss of the structure. In general, the higher the loss factor, the more effective is the acoustical structure in reducing the transmission or reflection of sound, as the case may be.

The need for acoustical structures can arise in both exterior and interior applications. For example, in urban settings it may be desired to shield residential neighborhoods from traffic noise generated by nearby freeways, expressways, railway tracks and the like. The conventional solution is to build a large wall made of bricks or cement cinder blocks alongside the thoroughfare. Although relatively expensive and labor intensive to construct, these walls are generally adequate as barriers to sound transmission. However, this solution to the noise problem suffers from the fact the walls also tend to be highly reflective, that is, they have a low absorption loss factor, with the result that they cause the level of traffic noise to increase on the thoroughfare side of the barrier. Moreover, to be effective noise barriers the walls may need to be so high as to create an unwanted visual obstruction and interfere with the receipt of natural light on one or both sides of the wall.

Applications for acoustical structures also arise in connection with buildings, whether the need is to control the acoustics of the building vis-a-vis its exterior or from room to room within the interior of the building. Here, a conventional solution is to use relatively thick panels to cover underlying structural support members. Again, such panels can be an effective barrier to sound transmission, but they too tend to be highly reflective. In addition, these panels have a similar problem of possibly creating an unwanted visual obstruction and interfering with the receipt of natural light from the outside, unless interrupted with windows, which only tends to exacerbate the problem of acoustic reflection. Moreover, when used on the exterior of a building, these cover panels require significant rigidity and strength to resist wind loading forces and the like that could otherwise deform, dismember or dislodge them. Consequently, these cover panels likewise tend to be heavy, labor intensive to install, and relatively expensive.

Accordingly, there exists a need for an effective noise barrier system that reduces both transmitted and reflected sound, transmits light, is lightweight, economical and easy to construct, and has the structural integrity to resist wind loading forces and the like. The present invention fulfills these needs.

SUMMARY OF THE INVENTION

Briefly, and in general terms, the present invention resides in an acoustical panel system having both relatively high insertion and absorption loss factors that utilizes thin sheet panels which are specially configured for structural integrity and which can be made transparent, translucent or opaque to permit or inhibit transmission of light as desired. The panel system is readily adaptable to the construction of walls, fences, and other structures to provide a simple and lightweight, yet effective solution to noise and related acoustical problems.

More specifically, the acoustical panel system of the present invention includes an acoustical panel having at least one raised body portion and an edge portion which surrounds the body portion. A bezel overlies the edge portion and is spaced from the body portion of the panel. The raised body portion of the panel makes possible a high insertion loss when it is backed by another panel or it is applied over an existing surface to form a hollow acoustical block, while the space between the body portion and the bezel creates an adjacent sound trap that results in a high absorption loss. The panel and the bezel together comprise an assembly module that can be efficiently and economically mounted in a frame structure to serve as a basic building block for a fence or a wall. Alternatively, a pair of such panels and their associated bezels can be adjoined back-to-back and mounted in a frame to form a two-sided acoustical structure.

The acoustical panel is preferably formed as a rectangularly-shaped structure from a single sheet of thin plastic material. In accordance with the invention, all or part of the body portion of the acoustical panel is corrugated to reduce specular reflection of sound waves and to enhance the structural integrity of the panel. In this regard, the body portion of the panel is characterized by a rectangular panel face having corrugations that extend diagonally or "bidirectionally" relative to the edge portion of the panel. The interior angles between corrugations in the panel face are selected to be greater than 90 degrees to avoid the effects of retroreflection (corner reflections) of both light and sound waves. For structural integrity, the bidirectionality of the corrugations in the panel face gives the thin panel material both strength and flexibility in two directions in order to better resist wind loading forces and the like. The body portion of the panel further includes a sidewall joining the panel face to the edge portion, and the sidewall also may have corrugations which extend toward the edge portion of the panel and which are intercorrugated with the diagonal corrugations in the panel face for added strength and flexibility.

The bezel enhances the effectiveness of the sound trap by virtue of the fact that it is a substantially hollow structure and has one or more openings through which sounds may be received and trapped within the bezel. To this end, the edge portion of the panel beneath the bezel may include a sound reflecting surface in the form of an upstanding rib that directs sound waves into the bezel openings, and the bezel itself may be filled with sound absorbing material. The bezel and the interstitial space between it and the side wall of the body portion of the panel are configured to act as a quarter-wave trap by shifting the phase of a multiplicity of acoustic frequencies (and their harmonics) that are of interest so that they tend to destructively interfere with sound having similar frequencies entering the trap, as well as with a portion of the sound incident on and reflected from the corrugated panel surface.

For efficiency and economy of manufacture and assembly, each acoustical panel may comprise a plurality of spaced-apart body portions and surrounding edge portions formed as part of a unitary structure from a single sheet of material. For example, the body portions may be formed in a two-by-two array of spaced-apart panel faces, with a bezel that is similarly divided into quadrants so that the bezel extends around the periphery of each body portion of the panel and overlies the edge portions surrounding each body portion. A pair of such panel arrays adjoined back-to-back, together with their corresponding bezels, forms a convenient assembly module that can be installed in an appropriate opening in a frame for efficient, pre-fabricated construction of acoustical wall sections.

The frame structure of the present invention comprises an assemblage of inner and outer frame members that form an egg crate-like array of openings into which the acoustical panel assembly modules can be installed. The frame members, which are preferably made of steel, can be interconnected through various combinations of tongues and slots, and then held together by spot welding and a thermosetting, high strength conformal plastic coating. A plurality of fastening tabs are formed in opposing rows along the inside surfaces of the frame members so as to protrude into the openings in the frame structure to serve as fasteners for the acoustical panels. The opposing rows of fastening tabs permit the installation of the acoustical panel assembly modules with a snap fit.

The novel features which are believed to be characteristic of the present invention, together with further objectives and advantages thereof, will be better understood from the following detailed description considered in connection with the accompanying drawings, wherein like numbers designate like elements. It should be expressly understood, however, that the drawings are for purposes of illustration and description only and are not intended as a definition of the limits of the invention.

DESCRIPTION OF THE DRAWINGS

FIG. 7 is a top view of the frame structure of FIG. 1;

FIG. 8*a* is a side view of a typical frame member utilized in the frame structure of FIG. 7, showing a series of tabs formed in the frame member for fastening the acoustical panel assembly modules in the frame structure;

FIG. 8*b* is a cross-sectional view taken along the line 8*b*—8*b* in FIG. 7;

FIG. 8*c* is a cross-sectional view taken along the line 8*c*—8*c* in FIG. 7;

FIG. 9*a* is a fragmentary perspective view illustrating an interlocking connection at the corner junction between two outer frame members of the frame structure of FIG. 7;

FIG. 9*b* is a fragmentary perspective view illustrating an interlocking connection between an inner frame member and an outer frame member of the frame structure of FIG. 7;

FIG. 9*c* is a fragmentary perspective view illustrating an interlocking connection between two inner frame members of the frame structure of FIG. 7;

FIG. 13 is a cross-sectional view taken along the line 13—13 in FIG. 10;

FIG. 13*a* is a cross-sectional view taken along the line 13*a*—13*a* in FIG. 13;

DETAILED DESCRIPTION OF THE PREFERRED EMBODIMENTS

Figure 1:
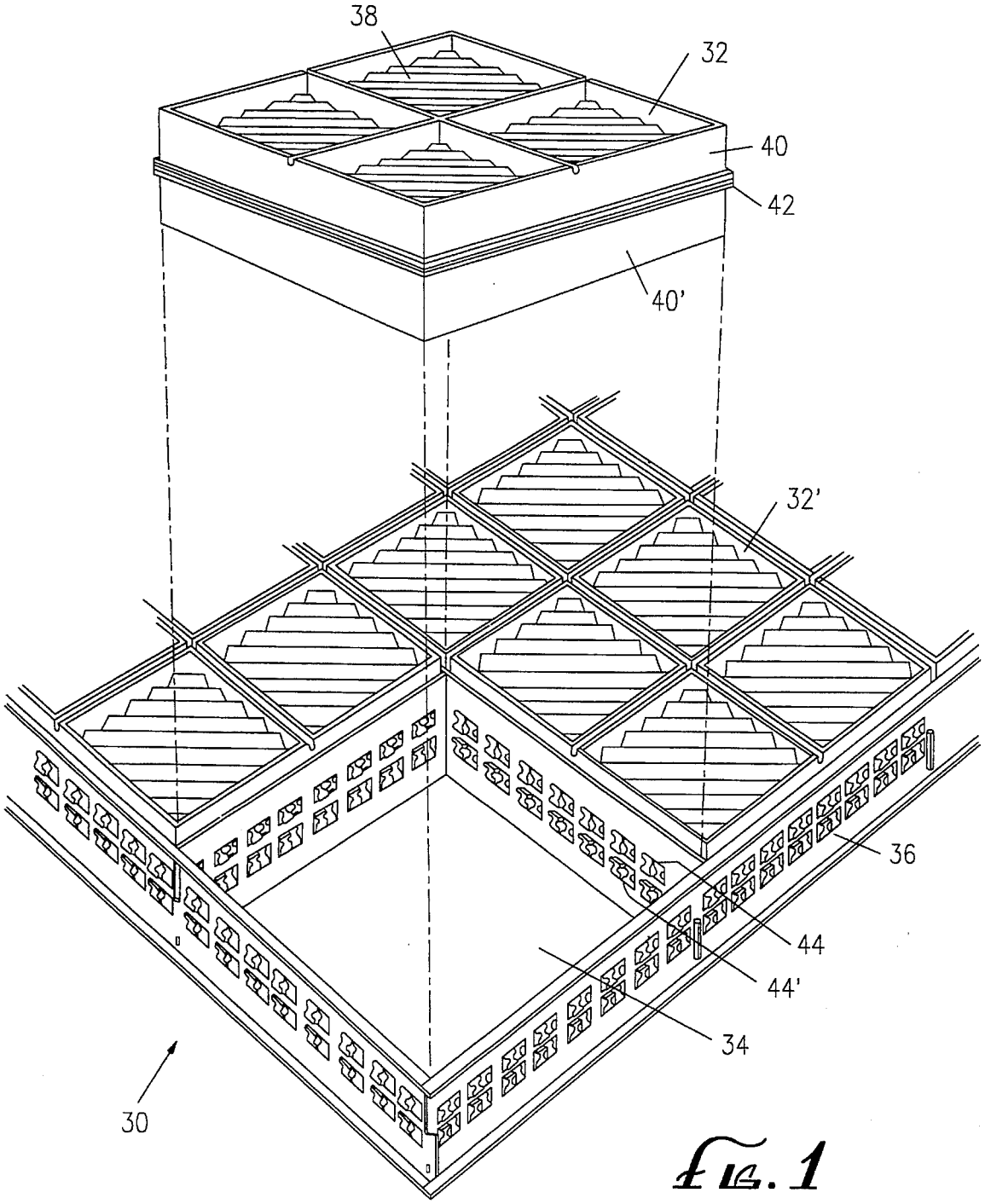
FIG. 1 is a fragmentary perspective view of an acoustical panel system constructed in accordance with the principles of the present invention, showing an acoustical panel assembly module positioned for installation into a frame structure with other acoustical panel modules.

Referring now to the drawings, and particularly to FIG. 1 thereof, there is shown by way of example an acoustical panel system, indicated generally by reference numeral 30, constructed in accordance with the principles of the present invention. As shown in FIG. 1, the acoustical panel system 30 comprises a plurality of acoustical panel assembly modules 32, 32' each of which is installed in an opening 34 of a frame structure 36. Although each acoustical panel assembly module 32 is shown as a two-sided assembly including a pair of acoustical panels 38, 38' (not visible in FIG. 1) and a pair of bezels 40, 40' (one for each panel), with a sealing gasket 42 covering their join, it will be appreciated that the invention can be constructed as a one-sided acoustical panel assembly as well. A double row of fastening tabs 44, 44' are formed in the frame structure 36 within the openings 34 to fasten the acoustical panel assembly modules 32 in place in a manner that will be discussed below.

Figure 2:
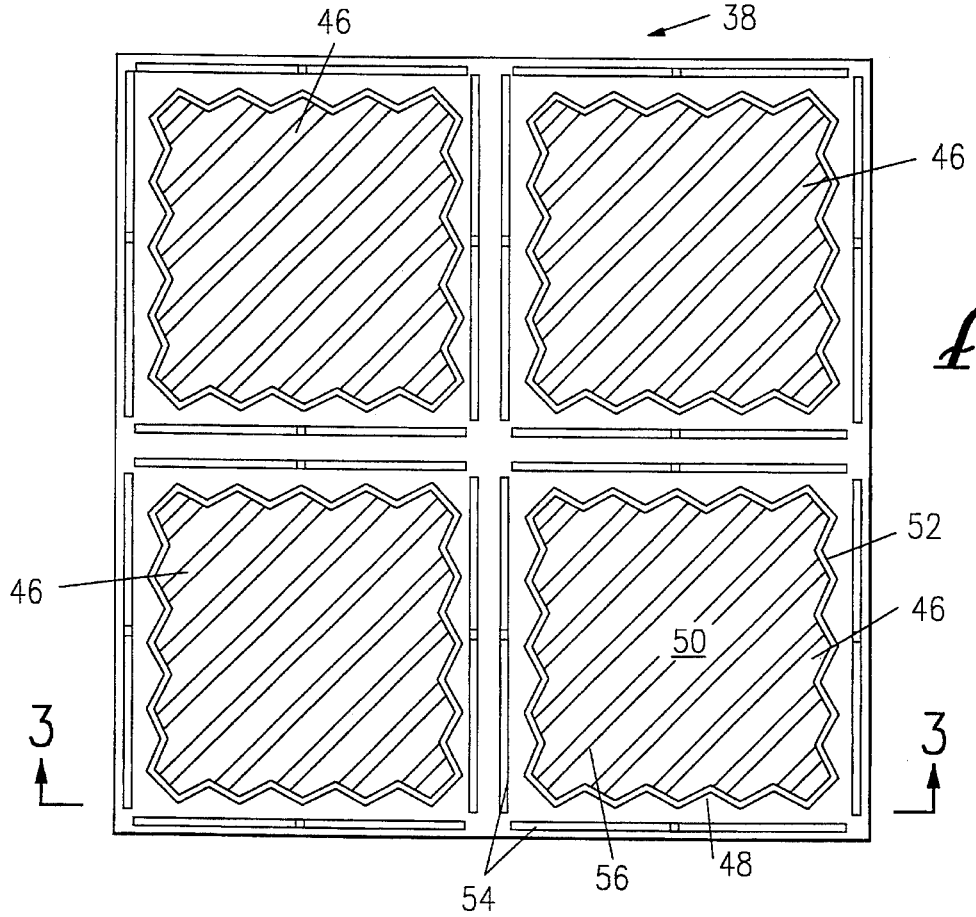
FIG. 2 is a top view of a bidirectionally corrugated acoustical panel array utilized in the assembly module of FIG. 1.
Figure 3:
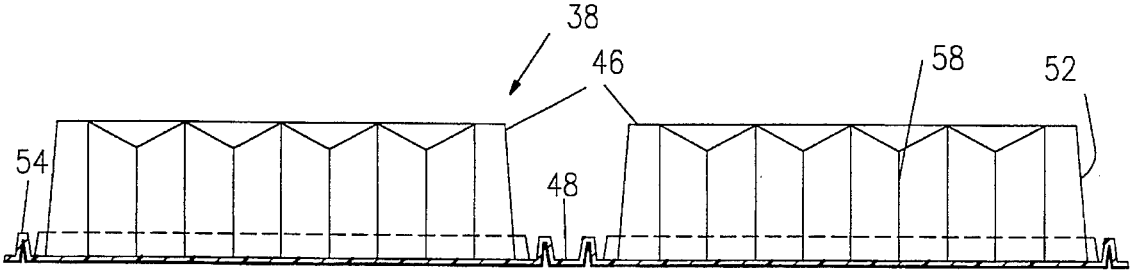
FIG. 3 is a cross-sectional view taken along the line 3—3 in FIG. 2.
Figure 4:
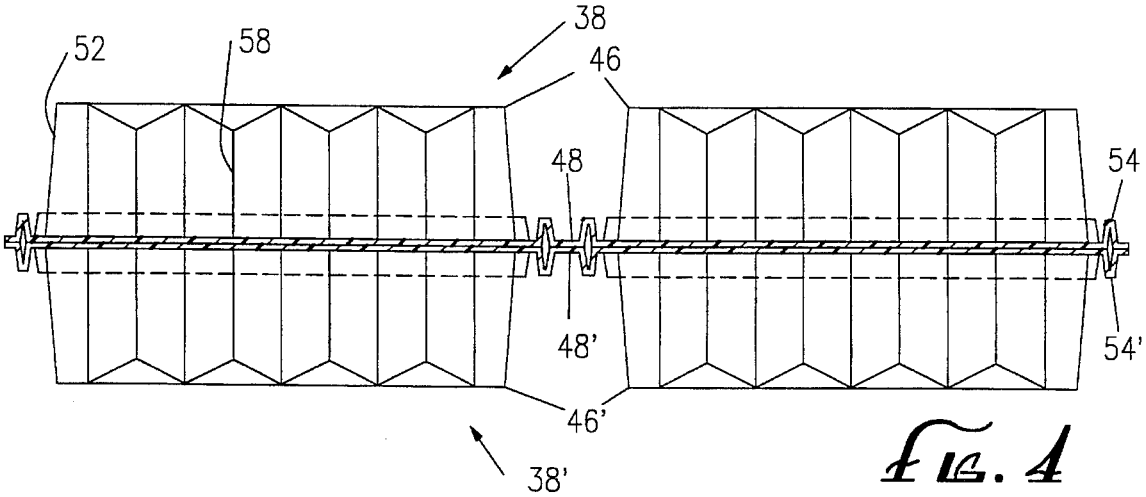
FIG. 4 is a cross-sectional view similar to FIG. 3, showing a pair of acoustical panel arrays adjoined prior to installation in the assembly module of FIG. 1.

As shown in FIGS. 2–4, the acoustical panel 38 has four identical corrugated body portions 46 arranged in a two-by-two array. Each body portion 46 is surrounded by an identical edge portion 48 and includes a panel face 50 and a sidewall 52 joining the panel faces to their corresponding edge portions. An upstanding rib 54 is formed on the edge portion 48 along each side of the body portion 46. By adjoining the pair of acoustical panels 38, 38' back-to-back, a two-by-two array of hollow acoustical blocks is formed (FIG. 4) for maximum insertion loss against transmission of sound.

As previously mentioned, the body portion 46 of each acoustical panel 38 is corrugated to avoid specular reflection of sound (i.e., to disperse the reflected sound in all directions). In this regard, the angles between the corrugations 56 in the panel face 50 of the body portion 46 are greater than 90 degrees to avoid simple corner reflections of sound waves, whereby the sound waves might otherwise be reflected back along their paths of incidence. Furthermore, it is contemplated that adjacent acoustical panel assembly modules 32, 32' may be turned at right angles to one another, rather than oriented all the same way as shown in FIG. 1, to increase the dispersion of the sound waves and possibly avoid undue reflective glare from sunlight. The corrugations 56 in the panel face 50 also give it structural strength and flexibility. To this end, the corrugations 56 extend diagonally relative to the edge portion 48 of the panel to give the thin panel material bidirectional strength and flexibility in order to better resist wind loading forces and the like in two directions. The sidewall 52 also has corrugations 58 which extend toward the edge portion of the panel and which are intercorrugated with the diagonal corrugations 56 in the panel face 50 for added strength and flexibility.

Figure 5:
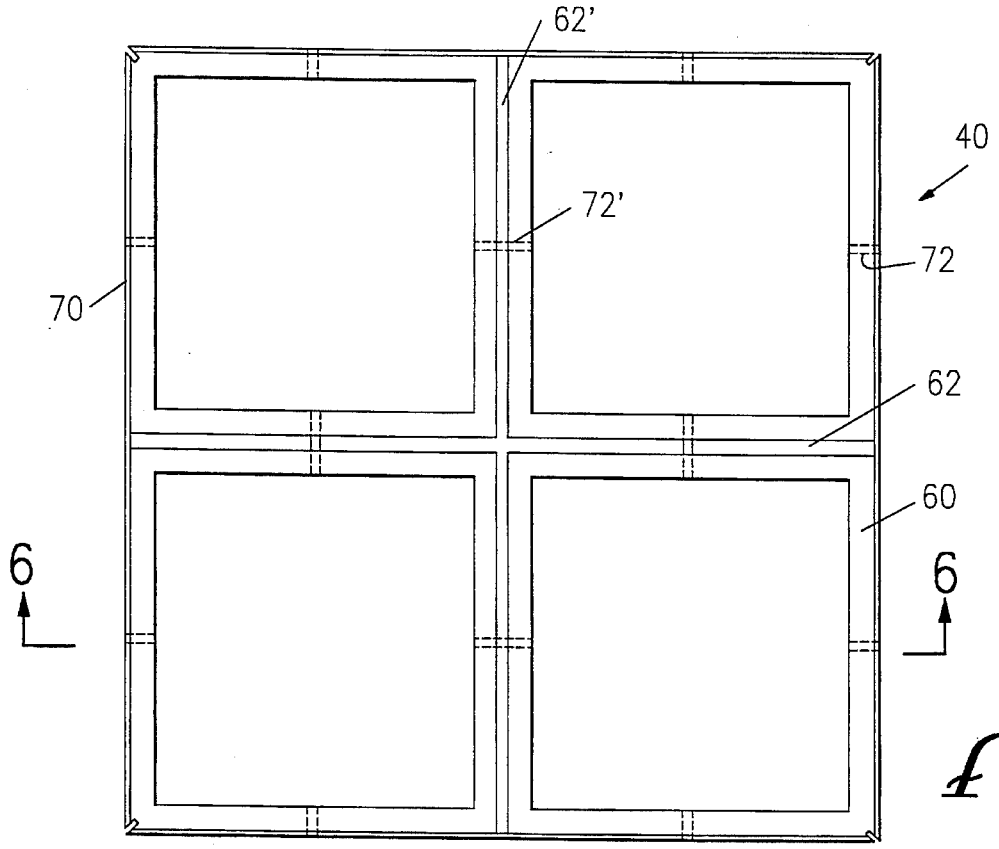
FIG. 5 is a top view of a bezel utilized in the assembly module of FIG. 1.
Figure 6:
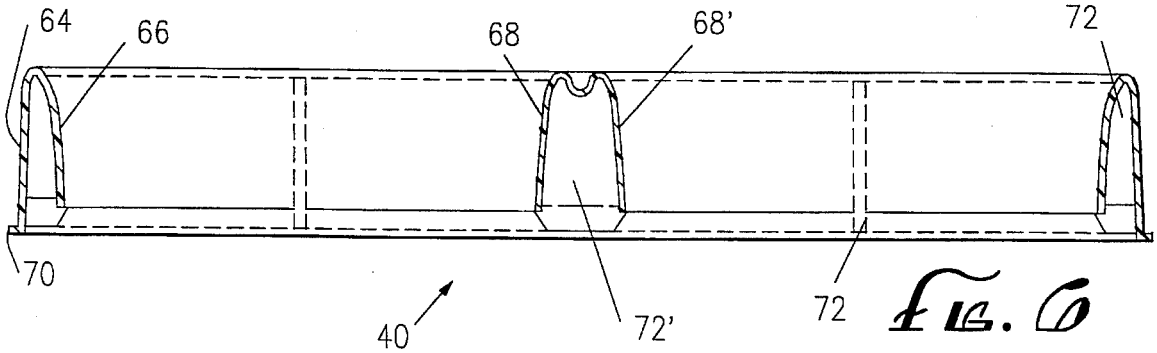
FIG. 6 is a cross-sectional view taken along the line 6—6 in FIG. 5.
Figure 10:
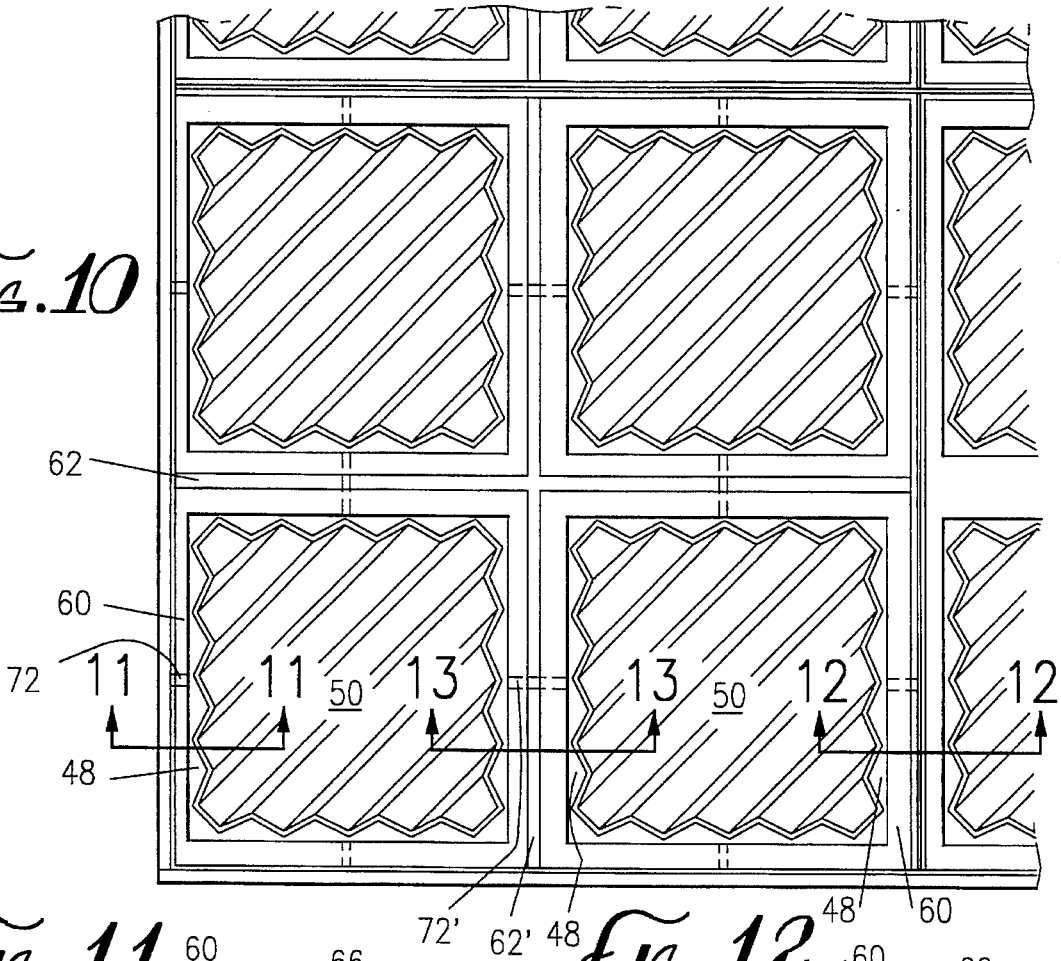
FIG. 10 is a fragmentary top view of the acoustical panel system of FIG. 1.
Figure 11:
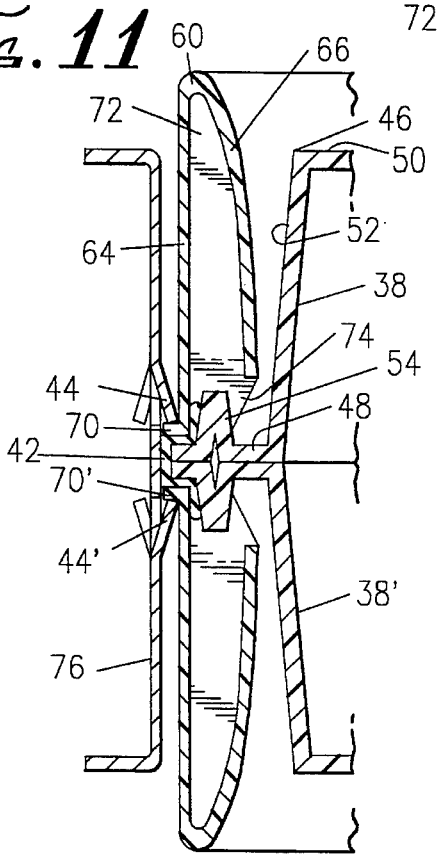
FIG. 11 is a cross-sectional view taken along the line 11—11 in FIG. 10.
Figure 12:
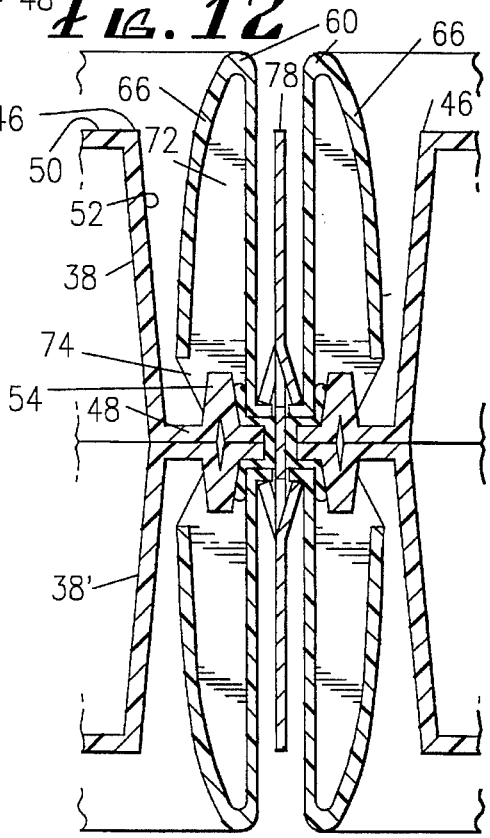
FIG. 12 is a cross-sectional view taken along the line 12—12 in FIG. 10.

In FIGS. 5–6 it can be seen that the bezel 40 has an outer rim 60 around its perimeter and a pair of inner rims 62, 62' which intersect and divide the bezel into quadrants. The outer rim 60 is a relatively tall and narrow structure, with a substantially vertical outer wall 64 and a sloping inner wall 66. The inner rims 62, 62' are the same height as the outer rim, but have essentially twice the thickness, with opposing walls 68, 68' that are sloped the same as the inner wall 66 of the outer rim 60 and double humped at the top to give the appearance of two rims, one associated with each quadrant. An outwardly protruding flange 70 is formed along the bottom edge of the outer rim 60 for purposes of assembly, as will become apparent. As best seen in FIG. 6, both the outer rim 60 and the inner rims 62, 62' are essentially hollow except for a number of reinforcing webs 72, 72' that are interspersed to strengthen the bezel prior to installation of the acoustical panel assembly module 32 into the frame structure 36 (FIG. 1).

Referring now to FIGS. 10–13, it can be seen that the inner wall 66 of the outer bezel rim 60 and the opposing walls 68, 68' of the inner bezel rims 62, 62' are everywhere spaced from the body portion 46 of the panel 38 when the bezel and the panel are assembled together. Significantly, although the spacing between the bezel 40 and the body portion 46 of the panel 38 is relatively narrow, the surface area of the spacing near the mouth of the opening between the bezel and the body portion is nearly one-half the area of the panel face 50. This interstitial spacing, which extends in two orthogonal directions around every body portion, allows incident sound waves from any direction to enter and travel to the edge portion 48 of the panel 38, where a portion of the sound waves are reflected back toward the panel face 50. By controlling the height of the raised body portion 46 of the panel 38 and the adjacent outer rim 60 and inner rims 62, 62' of the bezel 40, the length of the path followed by the incident sound waves can be selected or "tuned" to create a quarter-wave effect in which the reflected sound waves at the frequencies of interest are phase-shifted by about 180 degrees so as to destructively interfere with the incident sound waves at those frequencies being reflectively dispersed by the corrugations 56 in the panel face 50.

Further, the inner wall 66 of the outer rim 60 and the opposing walls 68, 68' of the inner rims 62, 62' of the bezel 40, adjacent the body portion 46 of the panel 38, do not extend all the way to the edge portion 48 of the panel. This creates an opening 74 into the hollow interior of the bezel 40 through which the remaining portion of the sound waves reflected from the edge portion 48 of the panel can be received. In this connection, the ribs 54 formed on the edge portion 48 of the panel 38 help reflect and direct the sound waves into the bezel interior. The hollow interior of the bezel 40 is likewise sized and shaped (i.e., "tuned") to create multiple and complex paths for those sound waves in order to promote further destructive interference within the bezel. Preferably, the bezel is filled with a sound absorbing material (not shown) to trap those sound waves within the bezel.

The acoustical panel 38 preferably is molded as a thin unitary structure from a polycarbonate plastic, which can be made transparent or translucent to permit transmission of light through the panel. The bezel 40 also can be molded as a unitary structure out of a polycarbonate or possibly a less expensive plastic such as a vinyl because it is not intended to be translucent or transparent. Overall the panel 38 is about 16 inches on a side by about two inches high and utilizes material about 0.1 inches thick. Each body portion 46 is about 6.4 inches on a side, and the upstanding ribs 54 are about 0.3 inches high. The outer rim 60 and the inner rims 62, 62' are both about 2.4 inches high. The outer rim 60 is about 0.6 inches wide at its base, and the inner rims 62, 62' are about twice that width at their base.

The egg crate-like construction of the frame structure 36 is illustrated in FIGS. 7–9. The frame structure 36 includes outer frame members 76 in the form of channel beams, and inner frame members 78 in the form of flat beams, all of which are preferably made of steel. As previously mentioned, and as shown in FIGS. **8*a*–8*c*, both the outer frame members 76 and the inner frame members 78 have a plurality of fastening tabs 44, 44' formed in opposing rows along the frame members by a conventional punch process. The fastening tabs 44, 44' protrude into the openings in the frame structure to serve as fasteners for the acoustical panels as described below in connection with FIGS. 11–12**.

Where the outer frame members 76 and the inner frame members 78 intersect to define the openings 34 for the acoustical panel assembly modules 32, the frame members are connected by a variety of tongue and slot arrangements as shown in FIGS. **9*a*–9*c*. The frame members are spot welded at these points of intersection and are further held together by a conventional thermosetting, high strength conformal plastic coating, also known as "powder coating," which is intended to protect the steel from corrosion. The channel widths of the outer frame members 76** may be selected to facilitate attachment to any other suitable structural supports, studs, or posts to form the basic framework for a fence or wall or the like.

Turning again to FIGS. 10–13, the assembly of the acoustical panel assembly modules 32 and their installation into the openings 34 of the frame structure 36 will now be described. A pair of acoustical panels 38, 38' are first placed back-to-back and bonded together, as by ultrasonic welding, to form an array of four acoustical blocks. Next, the sealing gasket 42 is placed around the perimeter of the adjoining edge portions 48, 48' of the acoustical panels 38, 38'. The bezels 40, 40' are then placed over their respective panels 38, 38', capturing the sealing gasket 42 between the flanges 70, 70' on the bottom edges of the bezels and the adjoining edge portions 48, 48' of the panels. As shown in FIG. 13*a*, to aid in assembling the bezels 40, with the panels 38, the bezel webs 72 are received in cross-slots 80 formed in the ribs 54 on the edge portions 48 of the panels 38. The lower ends 82 of the webs 72 are themselves tapered and slotted to compress for a tight fit in the rib cross-slots 80. This completes the assembly of the acoustical panel assembly module 32. Finally, the entire assembly module 32 is installed in the frame structure 36 by inserting the assembly module into an opening 34 until one of the flanges 70', on the bezel 40', engages one row of fastening tabs 44 within the opening. Further insertion of the assembly module 32 will cause the row of fastening tabs 44 to momentarily yield until the assembly module passes by and abuts against the opposing row of fastening tabs 44', whereupon the one row of fastening tabs 44 will snap back to capture the assembly module in place. As the assembly module bears on the fastening tabs, the gasket 42 compresses between the bezel flanges 70, 70' and the adjoined edge portions 48, 48' of the panels 38, 38'. This compression, in turn, causes the gasket 42 to bulge out between the assembly module and the frame member to produce a watertight seal.

Figure 15B:
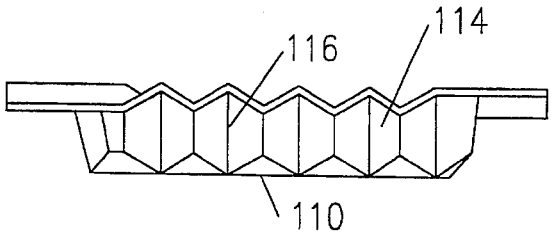
FIG. 15*b* is a side view of the acoustical panel of FIG. 14, taken from the side opposite FIG. 15*a;*
Figure 14:
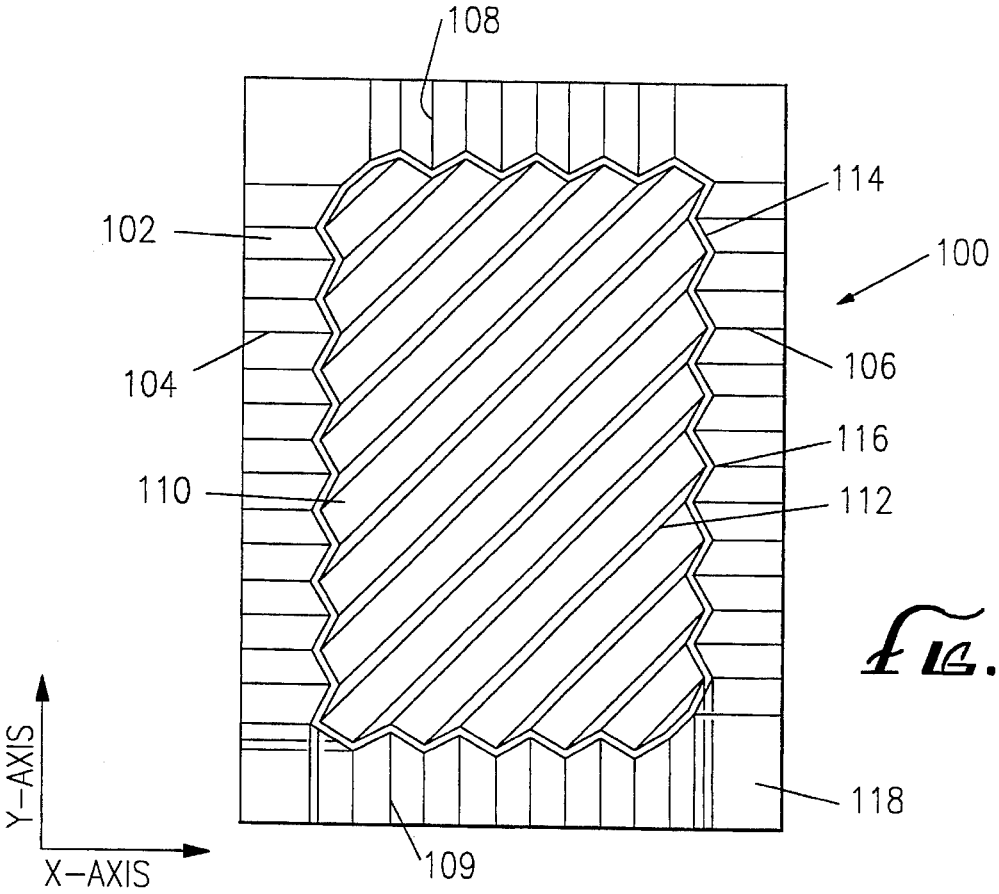
FIG. 14 is a top view of an alternative embodiment of a bidirectionally corrugated acoustical panel suitable for use in the acoustical panel system of the present invention.
Figure 15A:
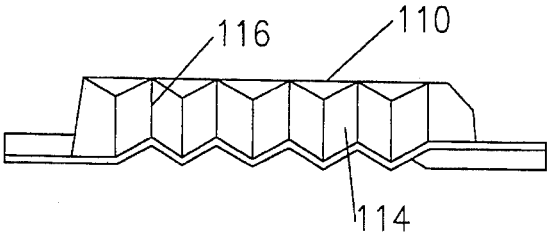
FIG. 15*a* is a side view of the acoustical panel of FIG. 14.

FIGS. 14–15 illustrate an alternative form of bidirectional acoustic panel. The bidirectional panel 100 is distinguished from the panels of FIGS. 2–4 primarily by the fact that the bidirectional panel includes an edge portion 102 having corrugations 104, 106 formed therein, rather than upstanding ribs as shown in FIGS. 2–4. The edge corrugations 104 and 106 are asymmetrical to each other; that is, where the edge corrugation 104 is at a peak, the corresponding edge corrugation 106 is at a valley. Similarly, edge corrugations 108 and 109 are asymmetrical, which has advantages that will become apparent in connection with FIG. 17 discussed below. Similar to the panels of FIGS. 2–4, the body portion 110 of the bidirectional panel 100 has corrugations 112 that are formed diagonally to the edge portion 102. As shown in FIGS. 14 and 15, the body portion 110 includes a sidewall 114 joining the edges portion 102 and having corrugations 116 directed toward the edge portion. The corrugations in the side wall are intercorrugated with both the diagonal corrugations 112 in the body portion 110 and with the edge corrugations 104, 106, 108, 109, as best seen in FIG. 14.

As discussed above, because the body corrugations are diagonal, increased flexibility of the body portions in both the X- and Y-axes results (FIG. 14). If the panel 100 were fixed to a structural support member by a mechanical fastener, such as a bolt located at the corners 118, it would still be able to deform in both the X- and Y-axes without the overall shape changing. The edge corrugations 104, 106 cooperate to allow flexibility along the Y-axis, while edge corrugations 108, 109 allow flexibility along the X-axis. This flexibility can be maintained even if additional fasteners are required to achieve the appropriate mechanical strength.

Figure 16:
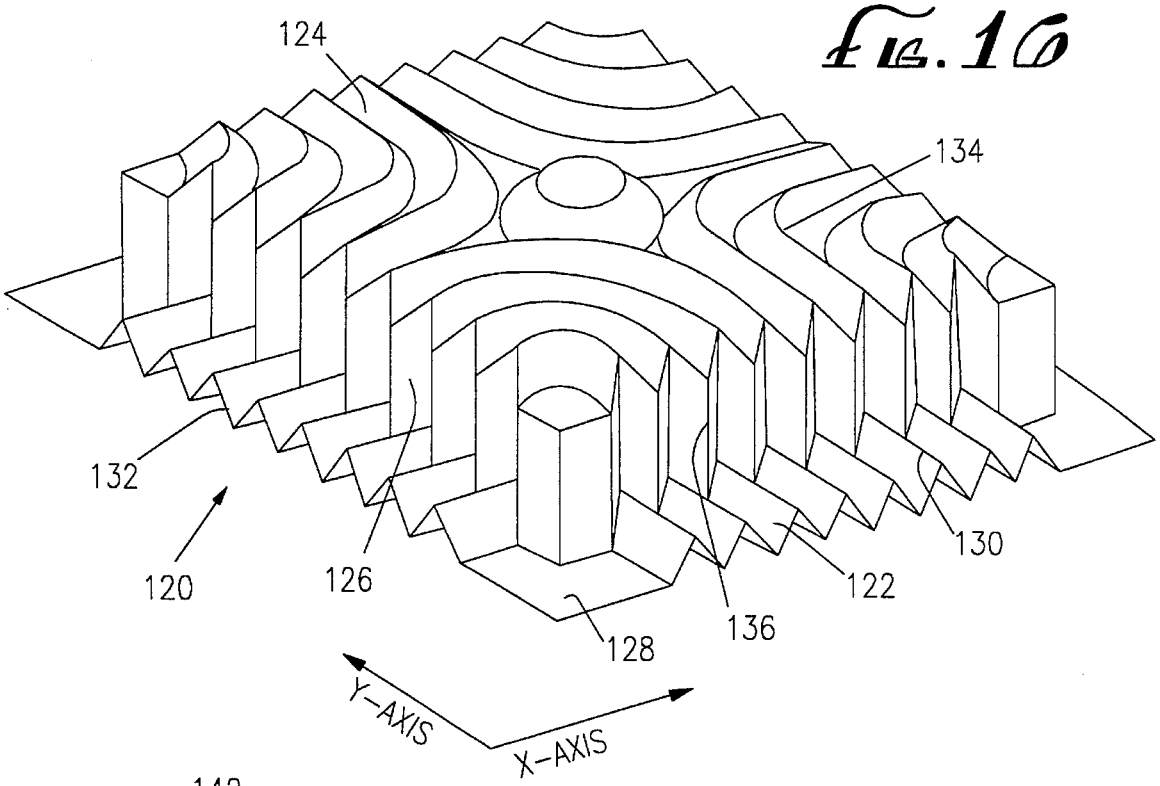
FIG. 16 is a perspective view of an another alternative embodiment of a bidirectionally corrugated acoustical panel suitable for use in the acoustical panel system of the present invention.

FIG. 16 shows yet another embodiment of an acoustical panel having similar bidirectional flexibility. In this embodiment, the panel 120 has an edge portion 122 and a body portion 124 including a sidewall 126 similar to the bidirectional panel 100 of FIG. 14, with corners 128 that can be mechanically fastened to a support structure. The edge portions 122 have corrugations 130, 132, which allow for flexibility of the panel along both the X- and Y-axes. The body portion 124 likewise has diagonal body corrugations 134 which allow for flexure along both the X- and Y-axes, except that the corrugations are curvilinear and do not all extend in the same direction. Corrugations 136 in the sidewall 126 are intercorrugated with the body corrugations and the edge corrugations.

The acoustical panels illustrated in FIGS. 4, 14 and 16 are particularly useful when greater structural strength is needed in the panels. By having a mechanical fastening means, such as bolts located along the edges and at the panel corners, it is possible to obtain greater structural strength than by the panels attached to the structural support member as illustrated in FIG. 17.

Figure 17:
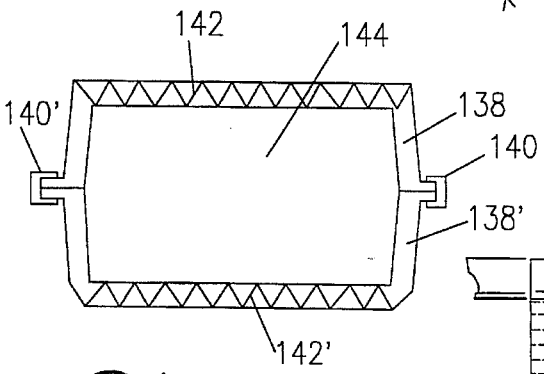
FIG. 17 is a side view of an alternative mounting structure for the acoustical panel of FIG. 14.

FIG. 17 illustrates a pair of bidirectional panels 138, 138' installed to created an acoustical block. Due to the previously described asymmetry of the edge corrugations, the edge corrugations of two panels can fit or nest together when two panels are placed back-to-back and placed in a channel 140, 140'. The body corrugations 142, 142' disturb the light traveling through the body portion such that images cannot clearly be seen through the corrugations, but light will travel through—the same effect as a glass brick. The mounting configuration in FIG. 17 also has heat insulating benefits from the fact that the combined panels forms a substantially closed air pocket 144. The mounting configuration in FIG. 17 also has advantageous sound absorbing properties.

Figure 18:
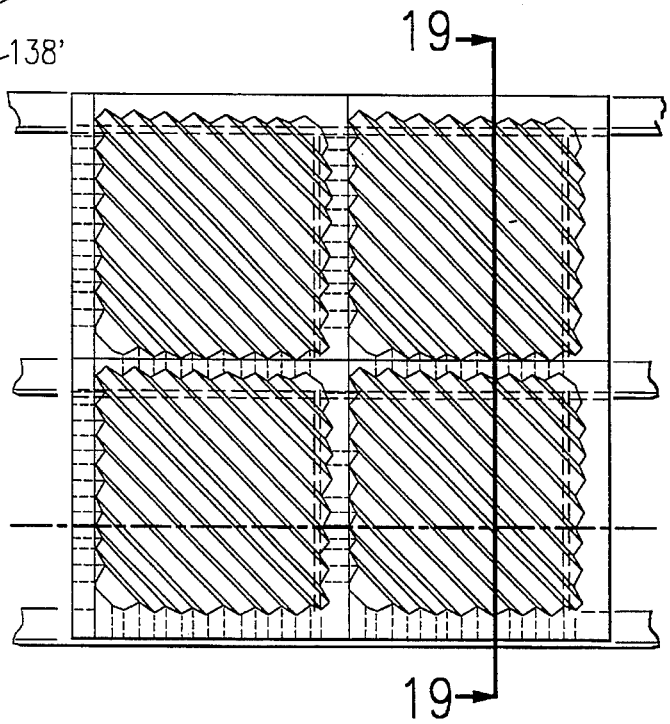
FIG. 18 is a top view of an alternative mounting structure for the acoustical panel of FIG. 14.
Figure 19:
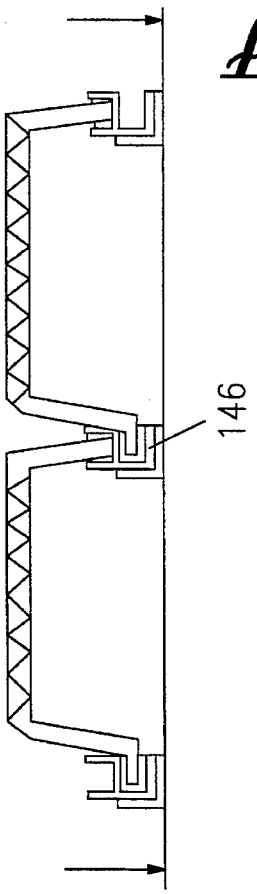
FIG. 19 is a side view of the mounting structure of FIG. 18.
Figure 20:
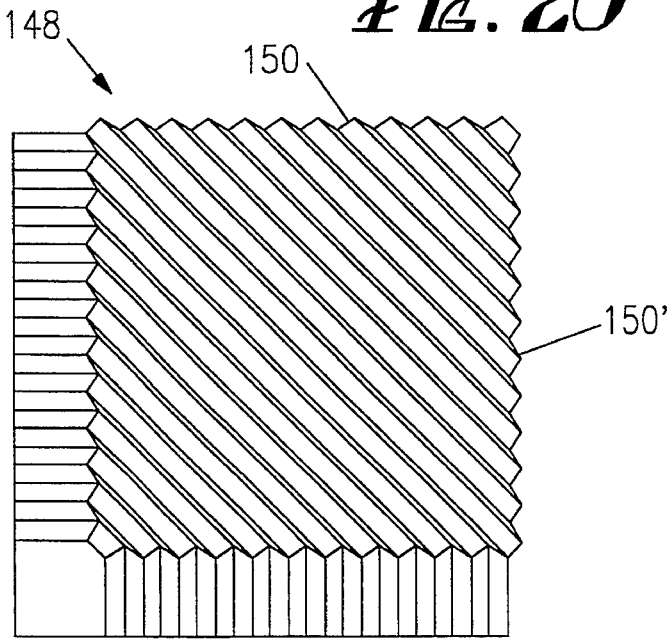
FIG. 20 is a top view of a modified form of the acoustical panel of FIG. 14 for use with the mounting structure of FIG. 17.
Figure 21:
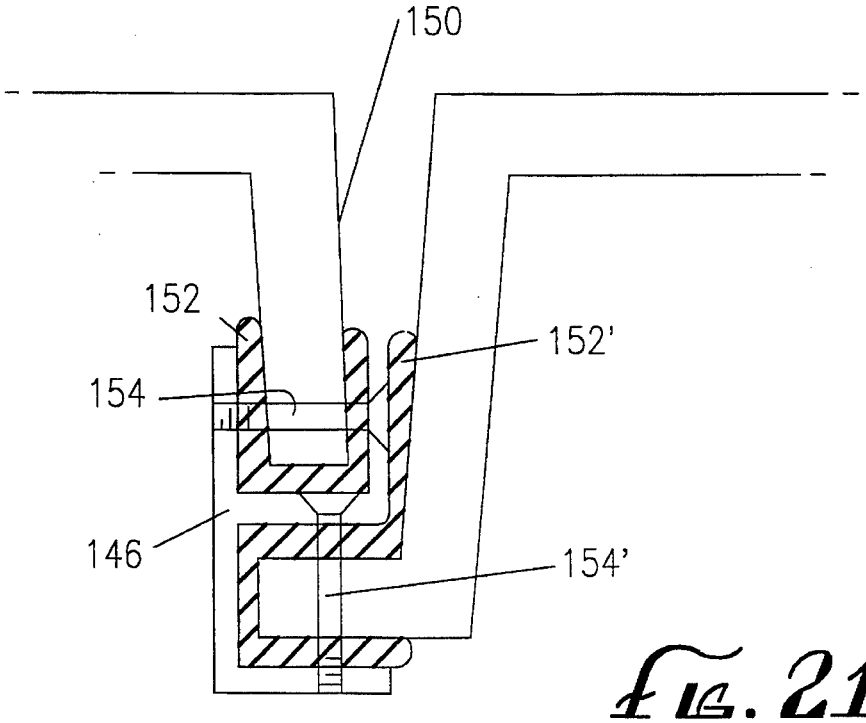
FIG. 21 is a side view of the orthogonal channel utilized in the mounting structure of FIG. 17.

The bidirectional panel can also be installed to substantially eliminate the installation channel assembly from view as illustrated in FIG. 18. FIG. 19 shows an orthogonal channel 146 which retains adjacent bidirectional panels. A bidirectional panel 148 illustrated in FIG. 20 is adapted from the panel illustrated in FIG. 14, by removing the edge portion from along two sides 150, 150' of the panel. When the adapted panel 148 is mounted in the orthogonal channel 146, the panel sides 150, 150' will substantially cover the orthogonal channel. FIG. 21 illustrates the orthogonal channel showing gaskets 152, 152' and fasteners 154, 154'.

It will, of course, be understood that modifications of the present invention will be apparent to others skilled in the art. Consequently, the scope of the present should not be limited by the particular embodiments described above but should be defined only by the claims put forth below and equivalents thereof.

I claim:

1. An acoustical panel system, comprising:

an acoustical block including a first panel and a second panel, each of the panels having at least one continuous body portion and a laterally-extending edge portion surrounding the periphery of the body portion, each body portion of each panel including a laterally-extending panel face that is raised relative to the edge portion of the panel and a generally upright sidewall projecting away from the panel face around the perimeter thereof and joining the panel face to the edge portion of the panel, the panel face of each body portion having corrugations formed therein, and wherein the first and second panels are disposed in back-to-back relationship with the edge portions of the first panel adjoined to the edge portions of the second panel so that opposing panel faces of the body portions of the panels are spaced apart to form a closed and hollow brick-like structure;

a frame defining an opening into which the acoustical block is received; and a plurality of fasteners fastening the acoustical block within the opening in the frame.

2. The acoustical panel system of claim 1, and further including a bezel extending around the periphery of each body portion of each panel and overlying the edge portion thereof.

3. The acoustical panel system of claim 2, wherein each bezel is spaced from the body portion of a panel by a prescribed amount.

4. The acoustical panel system of claim 2, wherein each bezel is a substantially hollow structure, and further wherein each bezel defines one or more openings into which sounds are received and trapped within the bezel.

5. The acoustical panel system of claim 1, wherein the fasteners comprise a plurality of fastening tabs protruding from the frame and disposed within the opening in the frame on opposite sides of the edge portions of the first and second panels, whereby the edge portions of the panels are captured between the tabs to secure the acoustical block in place.

6. The acoustical panel system of claim 1, wherein the panel face of the body portion of at least one panel has a generally planar surface.

7. The acoustical panel system of claim 1, wherein the perimeter of the panel face of the body portion of at least one panel is generally polygonal.

8. The acoustical panel system of claim 7, wherein the perimeter of the panel face of the body portion of at least one panel is rectangular, and the corrugations in the panel face extend diagonally relative thereto.

9. The acoustical panel system of claim 1, wherein at least a portion of the corrugations in the panel face of the body portion of at least one panel are curvilinear.

10. An acoustical panel system, comprising:

an acoustical block including a first panel and a second panel each formed as a unitary structure, each of the panels having a plurality of spaced-apart continuous body portions and a laterally-extending edge portion surrounding each body portion, each body portion of each panel including a laterally-extending panel face that is raised relative to the edge portion surrounding the body portion and a generally upright sidewall projecting away from the panel face around the perimeter thereof and joining the panel face to the edge portion, the panel face of each body portion having corrugations formed therein, and wherein the first and second panels are disposed in back-to-back relationship with the edge portions of the first panel adjoined to the edge portions of the second panel so that opposing panel faces of the body portions of the panels are spaced apart to form a closed and hollow brick-like structure;

a frame defining an opening into which the acoustical block is received;

a plurality of fasteners fastening the acoustical block within the opening in the frame: and a bezel extending around the periphery of each body portion of each panel and overlying the surrounding edge portion thereof.

11. The acoustical panel system of claim 10, wherein each bezel is spaced from each body portion of a panel by a prescribed amount to suppress sounds radiating therebetween.

12. The acoustical panel system of claim 10, wherein each bezel is a substantially hollow structure, and further wherein each bezel defines one or more openings adjacent the body portion into which sounds are received and trapped within the bezel.

13. The acoustical panel system of claim 10, wherein the corrugations in the panel faces of each body portion of each panel intersect its perimeter in a direction transverse thereto around substantially the entire periphery thereof.

14. The acoustical panel system of claim 13, wherein each of the side walls of the body portions of each panel has corrugations formed therein extending in a direction toward the edge portion of the panel, and further wherein the corrugations in the side walls are intercorrugated with the corrugations in the panel faces of the body portions.

15. The acoustical panel system of claim 10, wherein the fasteners serve to fasten both the bezels and the acoustical block within the opening in the frame.

16. The acoustical panel system of claim 15, wherein the fasteners comprise a plurality of fastening tabs protruding from the frame and disposed within the opening in the frame on opposite sides of both the bezels and the edge portions of the first and second panels, whereby both bezels and the edge portions of the panels are captured between the tabs to secure the bezels and the acoustical block in place.

17. An acoustical block comprising a first panel and a second panel each formed as a unitary structure, each of the panels having a continuous body portion and at least two laterally-extending edge portions adjacent the body portion, the body portion of each panel including a laterally-extending panel face that is raised relative to the edge portions of the panel and at least one generally upright sidewall projecting away from the panel face around the perimeter thereof and joining the panel face to the edge portions, the panel faces of the body portions of each panel having corrugations formed therein, the corrugations in each panel face intersecting its perimeter in a direction transverse thereto around substantially the entire periphery thereof, and wherein the first and second panels are disposed in back-to-back relationship with the edge portions of the first panel adjoined to the edge portions of the second panel so that the panel faces of body portions of the first panel and the second panel are spaced apart to form a closed and hollow brick-like structure.

18. The acoustical block of claim 17, wherein the sidewall of each body portion of each panel further has corrugations formed therein.

19. The acoustical block of claim 18, wherein the corrugations in each of the sidewalls extend in a direction toward the edge portions of the panel.

20. The acoustical block of claim 18, wherein the corrugations in the sidewalls are intercorrugated with the corrugations in the panel faces.

21. An acoustical block comprising a first panel and a second panel each formed as a unitary structure, each of the panels having a continuous body portion and a laterally-extending edge portion adjacent each side of the body portion, the body portion of each panel including a laterally-extending panel face that is raised relative to the edge portions of the panel, each body portion further including a generally upright sidewall projecting away from the panel face around the perimeter thereof and joining each edge portion to one side of the panel face of the body portion, wherein at least one of the body portions has corrugations formed in both the panel face and sidewall thereof, the corrugations in the panel face intersecting its perimeter in a direction transverse thereto around substantially the entire periphery thereof, and the corrugations in the side wall of the body portion of the panel being intercorrugated with the corrugations in the panel face, and further wherein the first and second panels are disposed in back-to-back relationship with the edge portions of the first panel adjoined to the edge portions of the second panel so that opposing panel faces of the body portions of the panels are spaced apart to form a closed and hollow brick-like structure.

22. An acoustical panel system, comprising:

an acoustical block including a first panel and a second panel, each of the panels having at least one body portion and a laterally-extending edge portion surrounding the periphery of the body portion, each body portion of each panel including a laterally-extending panel face that is raised relative to the edge portion of the panel and a generally upright sidewall projecting away from the panel face around the perimeter thereof and joining the panel face to the edge portion of the panel, the panel face of each body portion having corrugations formed therein that intersect its perimeter in a direction transverse thereto around substantially the entire periphery thereof, wherein the first and second panels are disposed in back-to-back relationship with the edge portions of the first panel adjoined to the edge portions of the second panel so that opposing panel faces of the body portions of the panels are spaced apart to form a hollow brick-like structure;

a frame defining an opening into which the acoustical block is received; and a plurality of fasteners fastening the acoustical block within the opening in the frame.

23. The acoustical panel system of claim 22, wherein each of the side walls of the body portions of each panel has corrugations formed therein extending in a direction toward the edge portion of the panel.

24. The acoustical panel system of claim 22, wherein each of the side walls of the body portions has corrugations formed therein which are intercorrugated with the corrugations in the panel faces of the body portions.

25. The acoustical panel system of claim 22, and further including:

a bezel extending around the periphery of each body portion of each panel and overlying the edge portion thereof, wherein each bezel is a substantially hollow structure which is spaced from the body portion of a panel by a prescribed amount, and further wherein each bezel defines one or more openings adjacent the body portion into which sounds are received and trapped within the bezel.

26. An acoustical panel system, comprising:

an acoustical block including a first panel and a second panel, each of the panels having at least one body portion and a laterally-extending edge portion surrounding the periphery of the body portion, each body portion of each panel including a laterally-extending panel face that is raised relative to the edge portion of the panel and a generally upright sidewall projecting away from the panel face around the perimeter thereof and joining the panel face to the edge portion of the panel, the panel face of each body portion having corrugations formed therein, and wherein the first and second panels are disposed in back-to-back relationship with the edge portions of the first panel adjoined to the edge portions of the second panel so that opposing panel faces of the body portions of the panels are spaced apart to form a hollow brick-like structure;

a frame defining an opening into which the acoustical block is received;

a plurality of fasteners fastening the acoustical block within the opening in the frame; and a bezel extending around the periphery of each body portion of each panel and overlying the edge portion thereof.

27. The acoustical panel system of claim 26, wherein each bezel is a substantially hollow structure which is spaced from the body portion of a panel by a prescribed amount, and further wherein each bezel defines one or more openings adjacent the body portion into which sounds are received and trapped within the bezel.

28. The acoustical panel system of claim 26, wherein the corrugations in the panel faces of each body portion of each panel intersect its perimeter in a direction transverse thereto around substantially the entire periphery thereof, and further wherein each of the side walls of the body portions of each panel have corrugations formed therein which are intercorrugated with the corrugations in the panel faces of the body portions and which extend in a direction toward the edge portions of the panels.

* * * * *